US006971978B2

(12) United States Patent
Hyder

(10) Patent No.: US 6,971,978 B2
(45) Date of Patent: Dec. 6, 2005

(54) BODY WEIGHT GRAVITY APPARATUS

(75) Inventor: Matthew Brian Hyder, Clearwater, FL (US)

(73) Assignee: Matthews Production Company, Inc., Clearwater, FL (US)

( * ) Notice: Subject to any disclaimer, the term of this patent is extended or adjusted under 35 U.S.C. 154(b) by 0 days.

(21) Appl. No.: 10/668,414

(22) Filed: Sep. 23, 2003

(65) Prior Publication Data

US 2004/0116258 A1 Jun. 17, 2004

Related U.S. Application Data

(60) Provisional application No. 60/432,960, filed on Dec. 12, 2002.

(51) Int. Cl.[7] ..... A63B 26/00

(52) U.S. Cl. ..... 482/142; 482/95; 482/100; 482/135

(58) Field of Search ..... 482/140, 142, 482/907–908, 94–112, 62, 135–137

(56) References Cited

U.S. PATENT DOCUMENTS 248,121 A * 10/1881 Tuttle ..... 482/96
5,352,171 A * 10/1994 Lin ..... 482/96
5,453,066 A * 9/1995 Richter, Jr. ..... 482/96
5,688,216 A * 11/1997 Mauriello ..... 482/135
5,733,229 A * 3/1998 Dalebout et al. ..... 482/96
5,743,832 A * 4/1998 Sands et al. ..... 482/52
5,749,813 A * 5/1998 Domzalski ..... 482/97
5,788,614 A * 8/1998 Simonson ..... 482/97
5,810,698 A * 9/1998 Hullett et al. ..... 482/96
6,394,936 B1 * 5/2002 Voris ..... 482/100
6,482,134 B1 * 11/2002 Rasmussen ..... 482/96
6,641,509 B1 * 11/2003 Chen ..... 482/94
6,746,385 B1 * 6/2004 Habing ..... 482/133

* cited by examiner

*Primary Examiner*—Stephen R. Crow
*Assistant Examiner*—L. Amerson
(74) *Attorney, Agent, or Firm*—Dennis G. Lapointe

(57) ABSTRACT

An exercise machine making use of the body weight of an exerciser as a load weight thereof comprises a horizontal base, a vertical bar member, an upper rocking bar member, a lower rocking bar member, a connection bar, a seat pad, a back pad, a handle, a pivoting cross member (V bar) and cushioning members. Unlike a conventional exercise machine, the exercise machine is composed of no weights. The vertical tube bar member is affixed to the base. The position of the upper rocking bar member can be adjusted by adjusting the pivoting position of the connection bar via the shuttle and two key pins. The exerciser can use the machine by sifting, kneeling, or standing on the seat pad of the machine for doing the muscle-building exercise.

5 Claims, 12 Drawing Sheets

BODY WEIGHT GRAVITY APPARATUS

This application claims the benefit of Provisional Application No. 60/432,960, filed Dec. 12, 2002.

FIELD OF THE INVENTION

The present invention relates generally to an exercise machine, and more particularly to an exercise machine which makes use of the body weight of an exerciser as a load weight or the resistance provided by the machine to the exerciser.

BACKGROUND OF THE INVENTION

The conventional exercise machine is generally provided with various weights, which are lifted by means of steel cables and pulleys or fixed plastic rods that are bent by means of various cable and pulleys for the purpose of building the body of a person using the exercise machine. Such a conventional exercise machine as described above is defective in that its weights are costly and that it is expensive and inconvenient to transport. Plastic rod systems lack the proper resistance and wear out to rapidly.

SUMMARY OF THE INVENTION

It is therefore the primary objective of the present invention to provide an exercise machine making use of the body weight of an exerciser as a load weight in place of a weight.

The foregoing objective of the present invention is attained by an exercise machine, which comprises a horizontal base, a vertical bar member, a lower rocking bar, an upper rocking bar, a connection bar, a seat pad, a back pad, a handle, a removable vertical cross member that attaches to the handle ends and cushioning members.

The vertical bar member is fastened obliquely to the horizontal base. The upper rocking bar is provided with a plurality of through holes and fastened pivotally to the top end of the vertical bar member. The lower rocking bar is pivoted to the vertical bar member such that the lower rocking bar is located under the upper rocking bar. The connection rod or bar is pivoted respectively at both ends thereof to the upper and the lower rocking bars and is located to the side of the vertical bar member. The seat pad is disposed on one end of the lower rocking bar. The back pad is pivoted at one end thereof to the lower rocking bar and glides at another end thereof on the vertical bar member.

The handle is fastened to one end of the upper rocking rod. The cushioning members are pivoted at one end thereof to the lower rocking bar and fastened at another end thereof to the vertical bar member.

More generally, the invention is an exercise machine making use of the body weight of an exerciser as a load weight thereof comprising:

a horizontal base;

a vertical bar member fastened obliquely at one end thereof to said base;

an upper rocking bar member provided with a predetermined number of spaced-apart through holes in a side edge of said upper rocking bar member and pivoted adjustably to a top end of said vertical bar member, the upper rocking bar member further including a spaced-apart elongate bar that runs parallel to the side edge of said upper rocking bar member and includes a plurality of spaced-apart through holes that align with the predetermined number of spaced-apart through holes in the upper rocking bar member;

a lower rocking bar member pivoted to said vertical bar member and located in a spaced-apart relationship underneath the upper rocking bar member;

a connection bar with both ends thereof pivoted respectively to said upper rocking bar member and said lower rocking bar member such that said connection bar is located to the side of the said vertical bar member, the connection bar further including a plurality of spaced-apart through holes for selective adjustment relative to the upper rocking bar member, and the connection bar extending between the upper rocking bar member side edge and its spaced-apart elongate bar;

a seat pad disposed on another end of said lower rocking bar member;

a padded back rest member having one end pivoted to said lower rocking bar member and another end lapped with a front surface of said vertical bar member;

a generally U-shaped handle bar fastened to a front end of said upper rocking bar member with hand grab means at each end thereof; and two cushioning members having one end pivoted to each side of said lower rocking bar member and another end pivoted to each corresponding side of said connection bar for enabling said lower rocking bar member to return to a stationary position at a moderate pace.

The connection bar further comprises a shuttle and two key pins with the lower end of the shuttle being pivotally and detachably connected to said vertical bar member. The shuttle is formed with two parallel plates in a spaced-apart relationship with the connection bar being capable of moving between said plates. The shuttle plates have three through holes, two near the shuttle plate top edge and one near the shuttle plate lower edge, the lower edge holes being that through which one of the key pins is insertable for engagement with the connection bar and the remaining two holes near the upper edge being that through which the other key pin is insertable for selective engagement with the upper rocking bar.

The vertical bar member is typically a vertical tube with one end fastened to said horizontal base.

The cushioning members are anticipated to be oil-pressure cylinders but other dampening shock or cushioning systems are contemplated to be within the scope of the invention.

A detachable cross member that pivotally connects to each end of the generally U-shaped handle is included. The cross member has a padded V shape at an intermediate location for alignment with an exerciser's neck.

The connection bar further includes a compressed spring at its lower end near the pivotable connection to the lower rocking bar member.

DETAILED DESCRIPTION OF THE INVENTION

Figure 1:
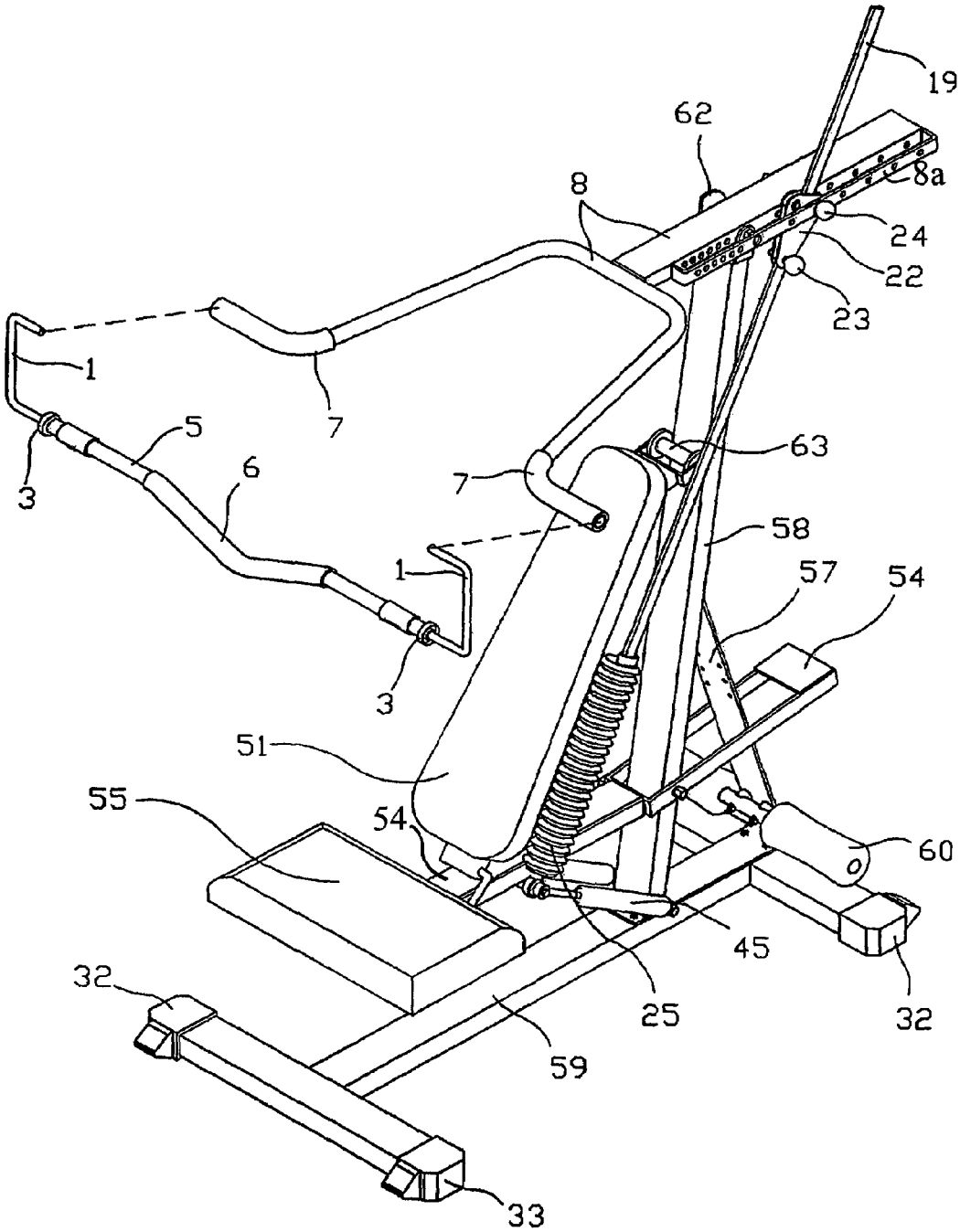
FIG. 1 shows a perspective view of the present invention.

As shown in FIG. 1, the exercise machine of the present invention is made up of the component parts described hereinafter.

A horizontal base 59 is composed of a main tube and two cross tubes fastened vertically and respectively to both ends of the main tube of horizontal base 59 and have a set of end caps with rollers 32 and 33 (on both sides). The horizontal base 59 is placed horizontally on a flat surface.

A vertical bar member 58 is fastened obliquely to the horizontal base 59. The upper rocking bar member 8, including a parallel elongate bar 8*a*, is provided with a predetermined number of through holes located on the side and is pivoted by means of a pivot assembly 62 that comprises of a flange and bushing, or a bearing and sleeve assembly that allows the upper rocking bar member 8 to pivot.

A lower rocking rod member 54 comprises two parallel beams, one support tube fastened to the two parallel beams. The lower rocking bar member 54 is arranged at both sides of the vertical bar member 58 by means of the two parallel beams. Located between two parallel beams and the vertical bar member 58 are two flanges not shown in the drawing for simplicity. A bushing or a bearing and sleeve assembly is horizontally inserted through the vertical bar member 58. A ½-13 UNC×4.75" bolt 15 is put through the two parallel beams, flanges and bushing, or a bearing and sleeve assembly and is then fastened with a nut.

Figure 6A:
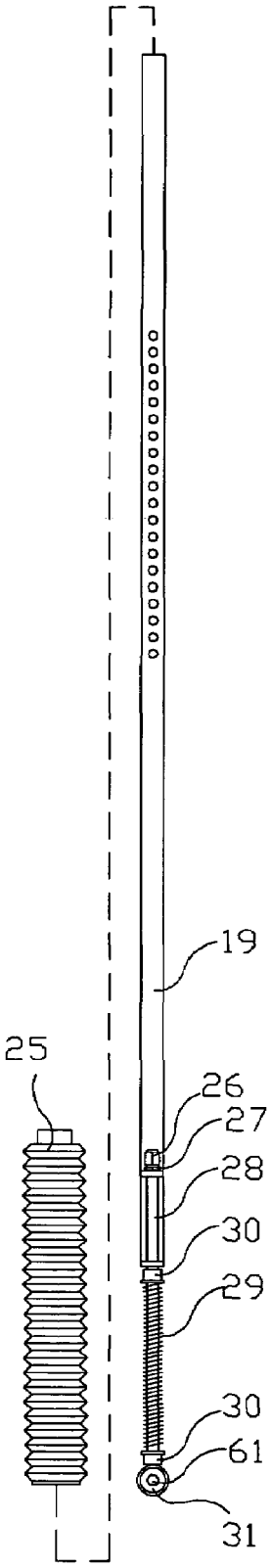
FIGS. 6*a* and 6*b* shows the plan and elevation views of the connection bar assembly.
Figure 6B:
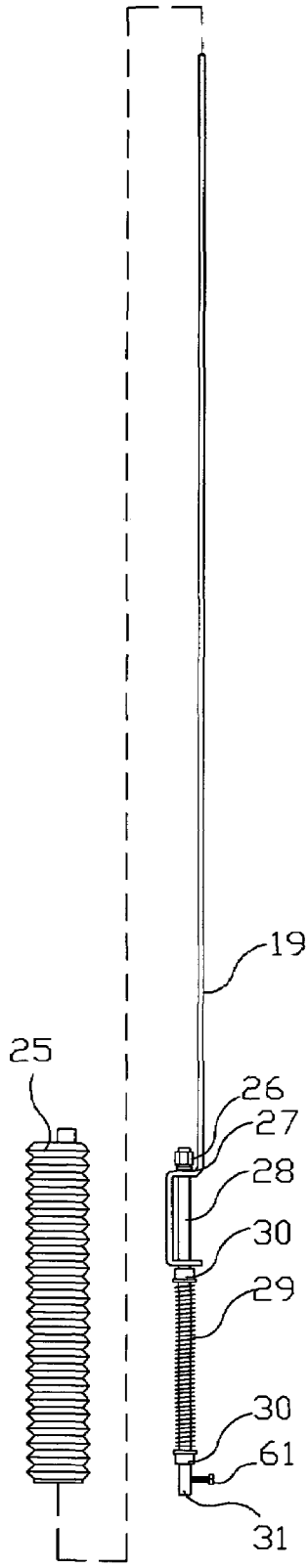

As shown in FIGS. 6*a* and 6*b*, a connection rod 19 comprises a plastic or rubberized cover 25, and a nut 26,and a washer 27, and a spring 29, and two spring caps 30, and a bearing. The connection bar 19 has 20 predetermined through holes that allow variations in the fulcrum via the shuttle 22 (shown in FIGS. 4*a*–4*b* and 5*a*–5*b*). The bearing of the connection bar is connected to the side of the lower rocking member 54 pivotally by a ½-20 UNC×2" bolt through bushing 61. As shown in FIGS. 4*a*–4*b* and 5*a*–5*b*, the upper portion of the connection bar 19 is pivoted to the upper rocking bar members 8 via the shuttle 22 and key pins 23 and 24.

A seat pad 55 is fastened securely at one end the lower rocking bar member 54. A back pad 51, as shown in FIG. 1, comprises of a support tube, and a backrest rod, which secures the backrest to the lower rocking member 54, and a rolling wheel 63 is pivotally mounted on the support tube so that the back pad 51 is held on to the vertical tube member 58 when the lower rocking bar member 54 is caused to rock upwards and downwards. The back pad 51 is detachably pivoted between the two members 54 and 58.

Two cushioning members 45 are oil-pressure cylinders and are pivoted at the sides of the vertical support member 58 and at another end to the sides of the lower rocking bar member 54, for allowing the lower rocking bar member 54 to return to its stationary position at a moderate pace.

A bracing tube 57 is fastened at one end thereof to the base 59 and at another end thereof to the vertical support or bar member 58. Provided respectively at both sides of the bracing tube 57 is an elastic padded tube 60.

Figure 2A:
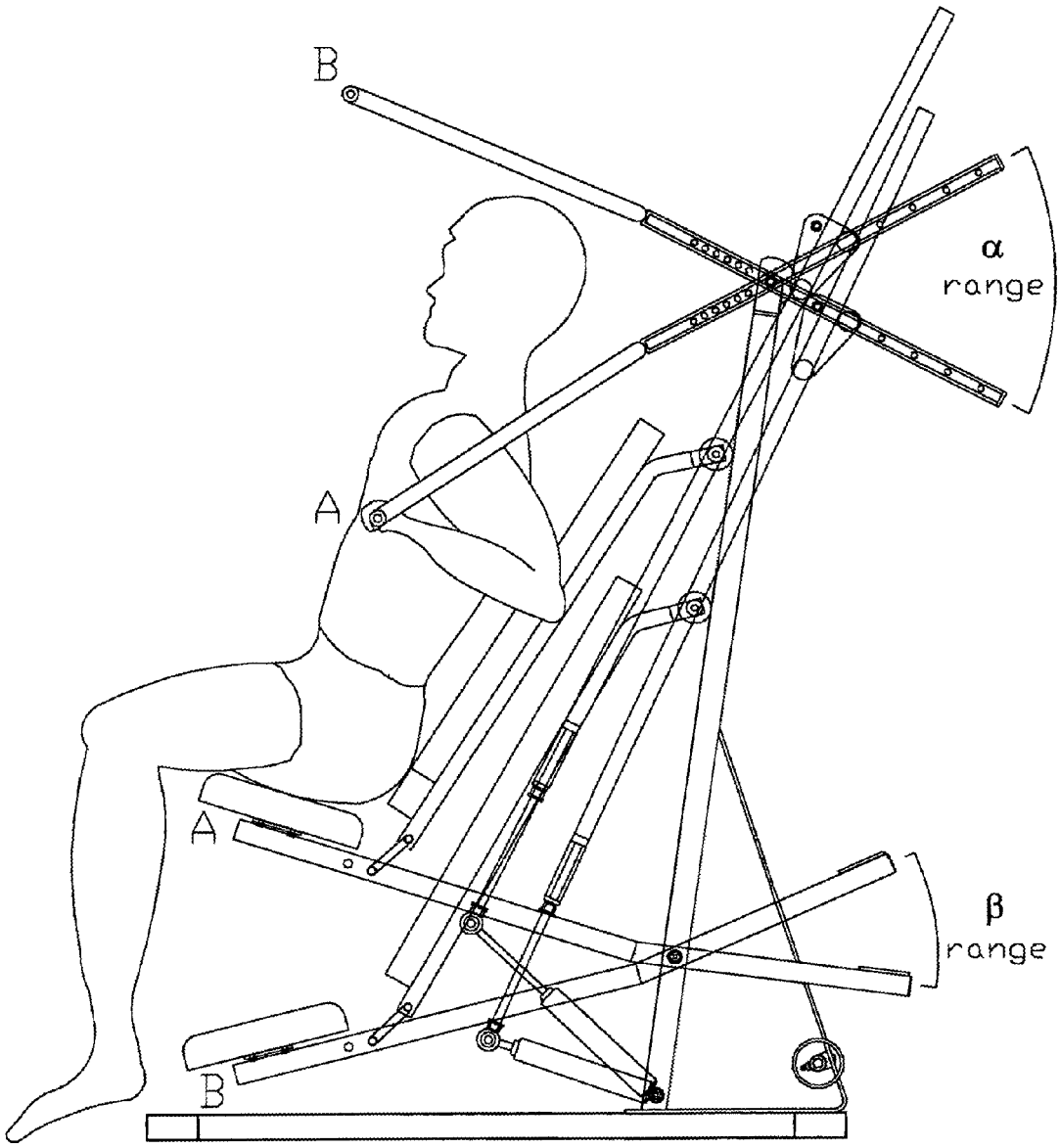
FIGS. 2*a* and 2*b* are schematic views illustrating the present invention in action.
Figure 2B:
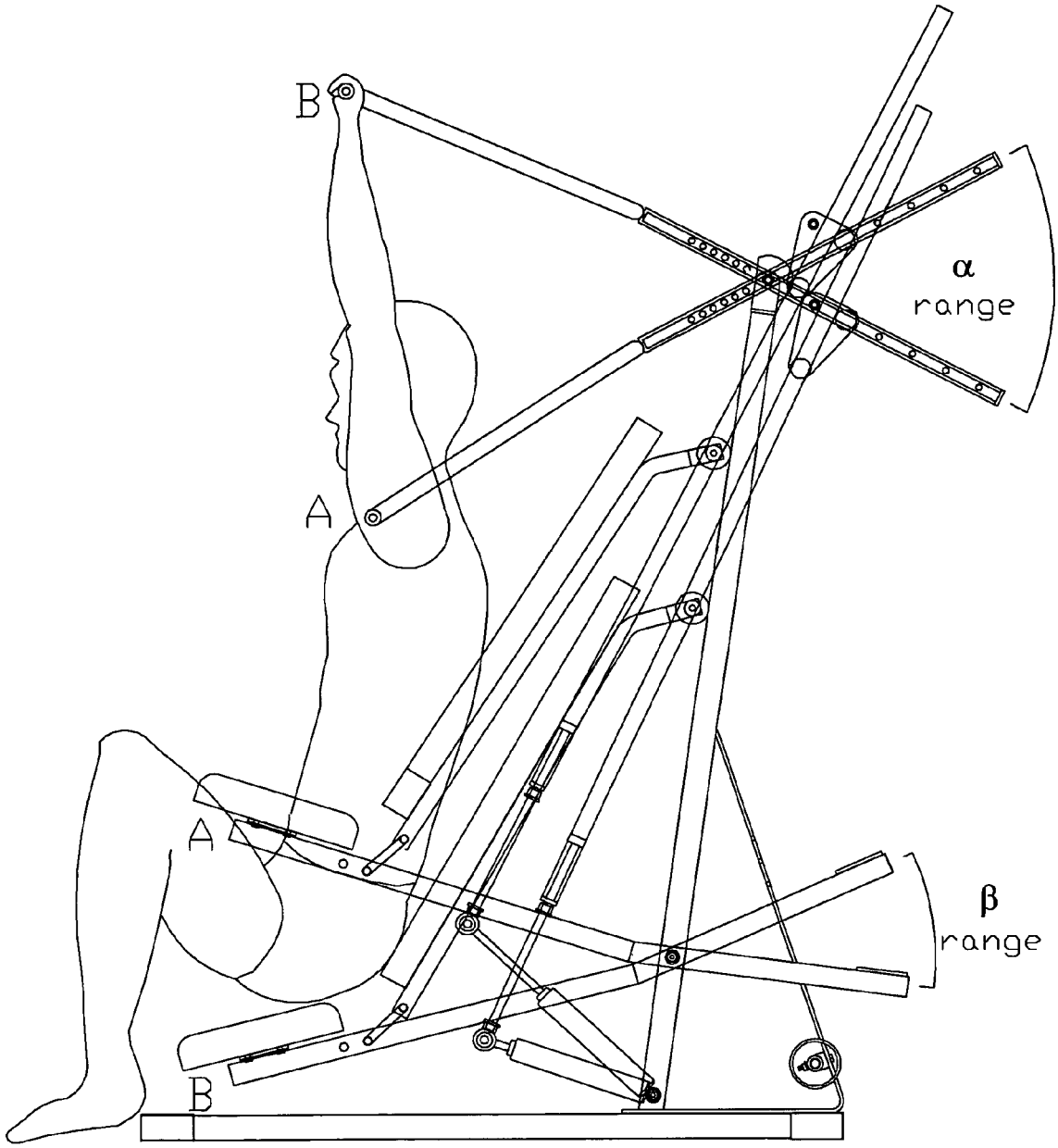
Figure 2C:
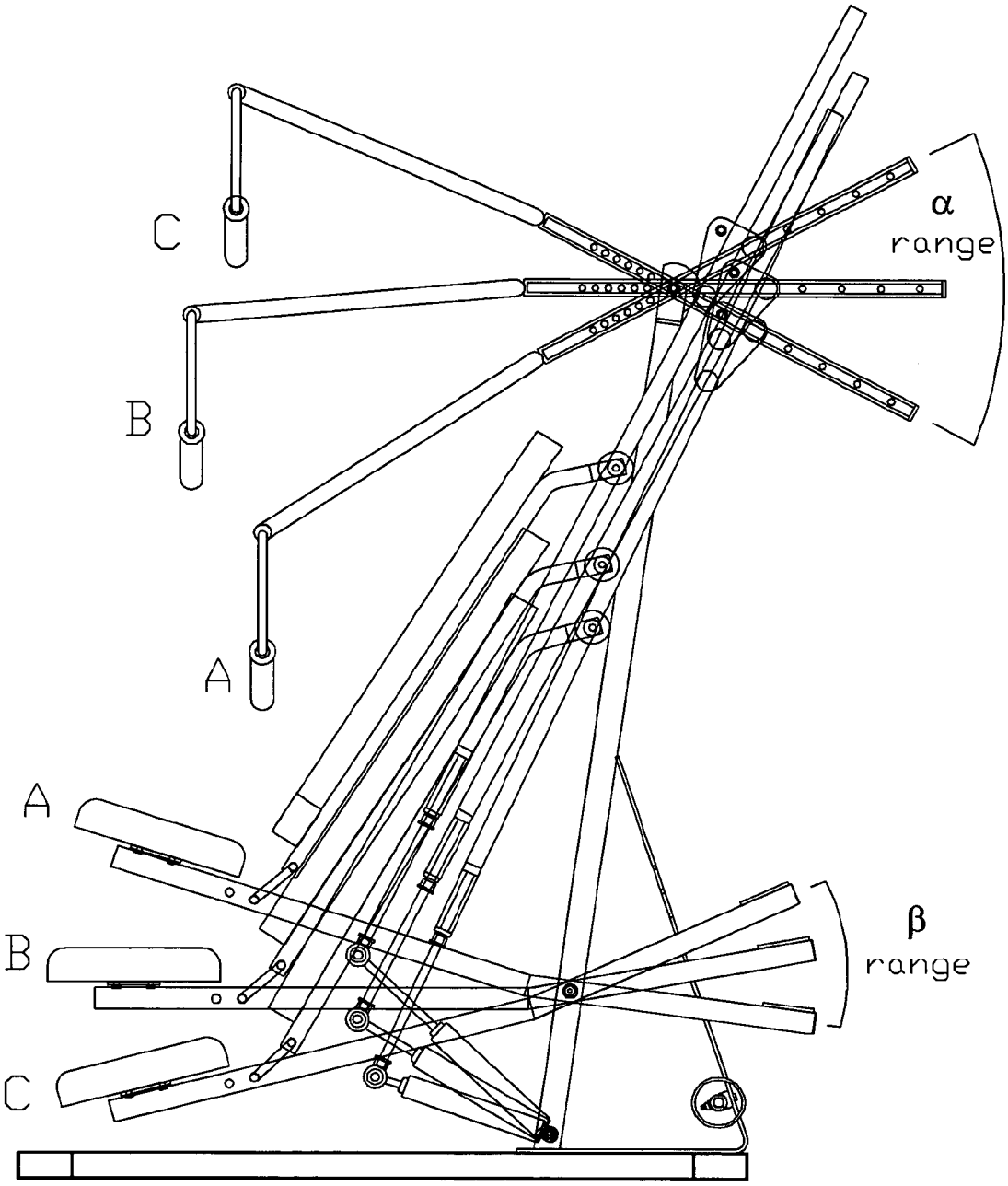
FIG. 2*c* is a schematic view illustrating the present invention in 3 positions with the shuttle to the back side of the top pivot assembly.
Figure 3:
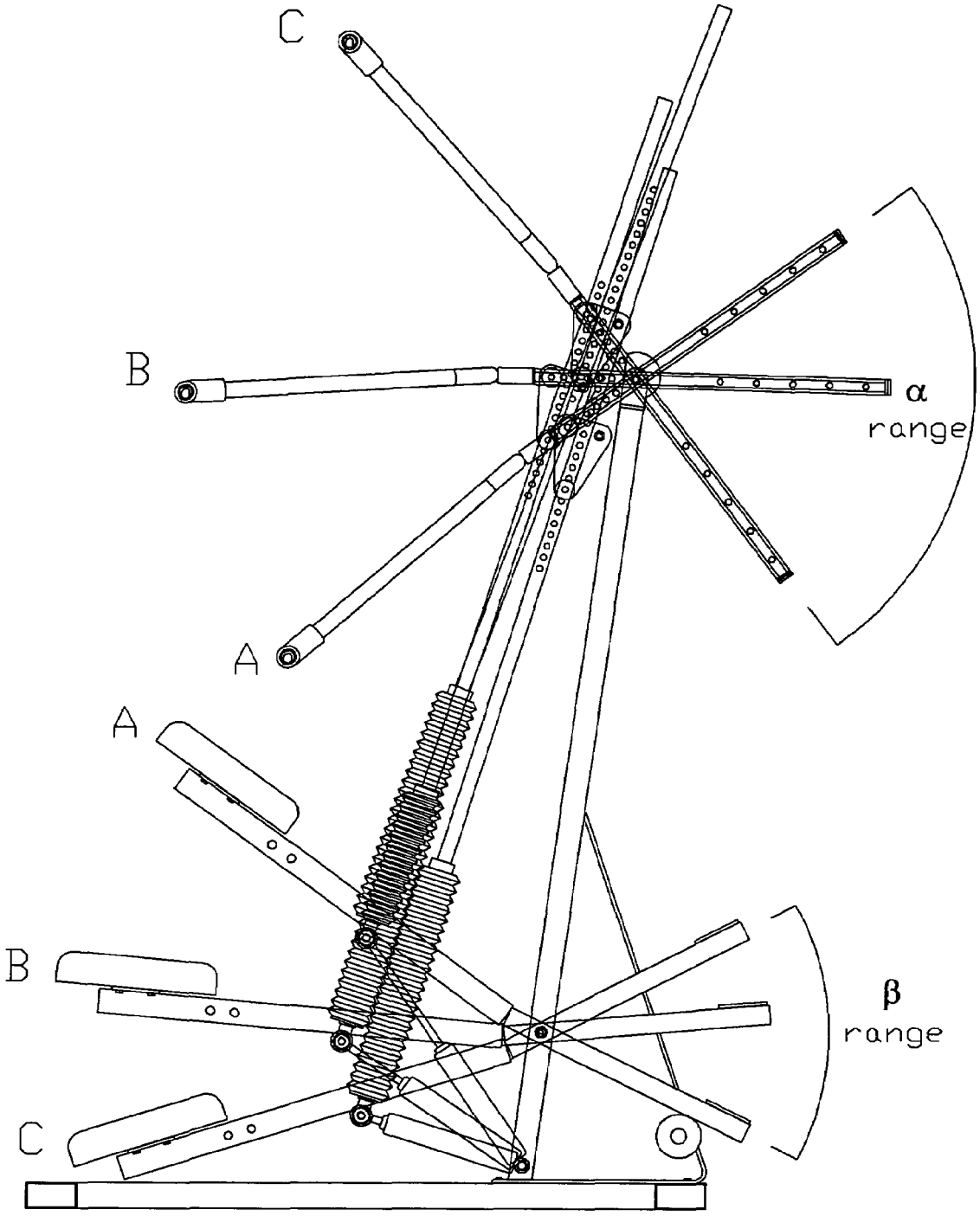
FIG. 3 is a schematic view illustrating the present invention in 3 positions with the shuttle to the front side of the top pivot assembly.
Figure 4A:
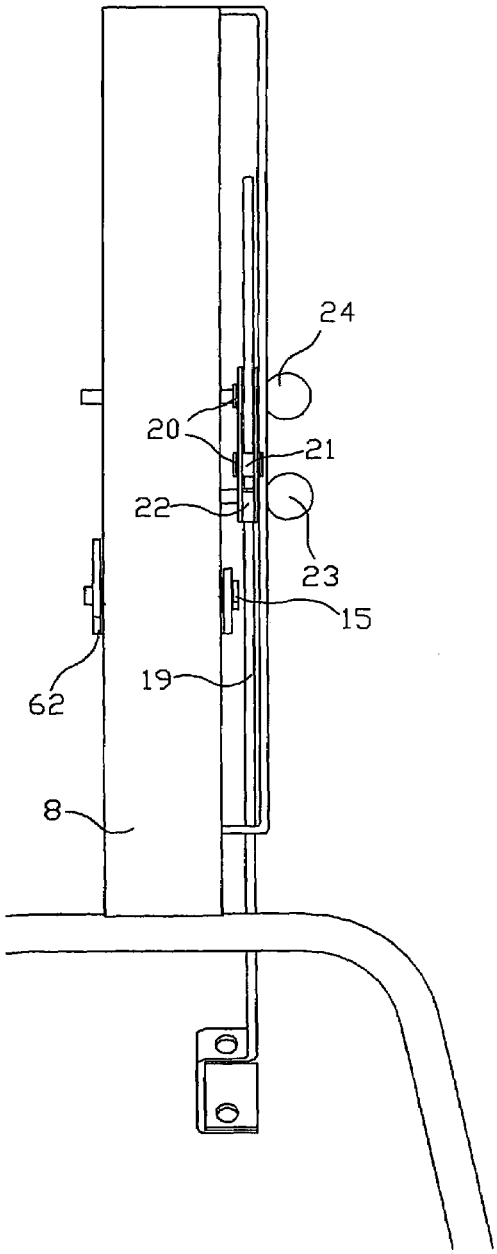
FIG. 4*a* shows the plan view of the correlation between the shuttle, connection bar, top pivot and handrail.
Figure 4B:
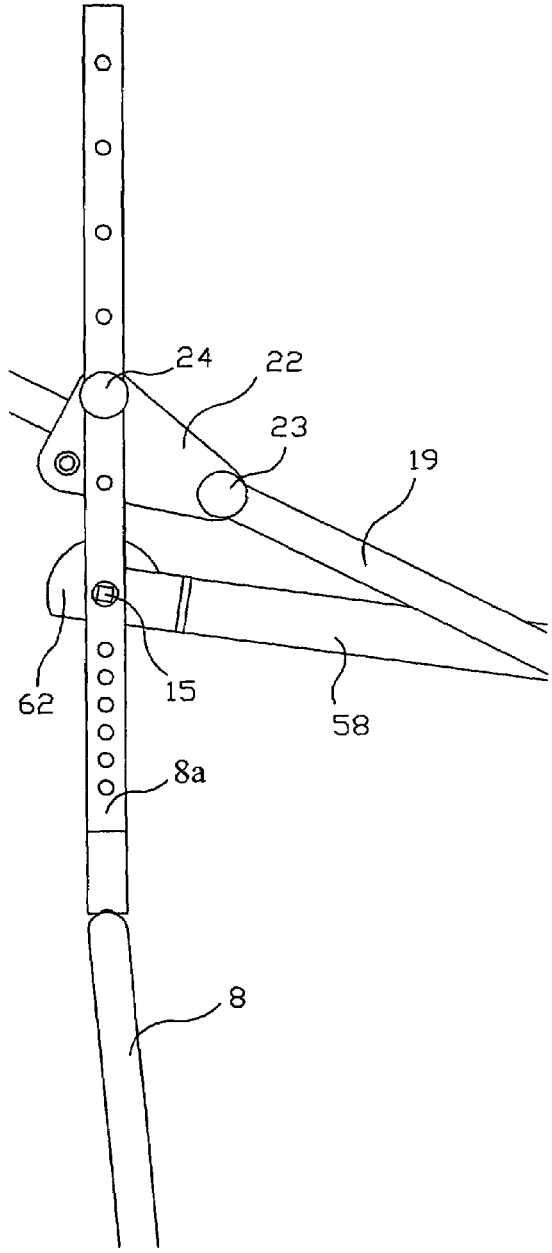
FIG. 4*b* shows the elevation view of the correlation between the shuttle, connection bar, top pivot and handrail.
Figure 5A:
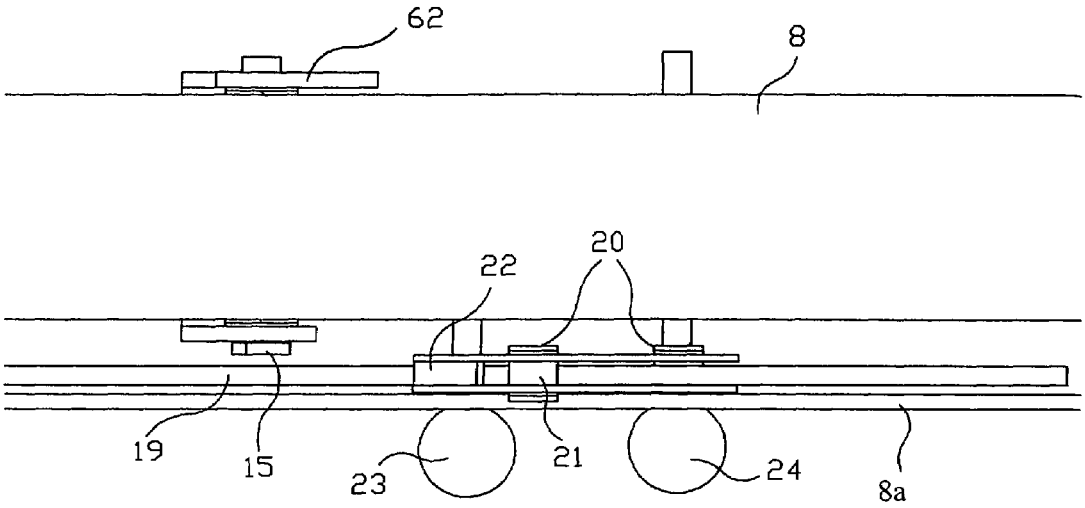
FIG. 5*a* shows the elevation view of the correlation between the shuttle, connection bar, top pivot and handrail.
Figure 5B:
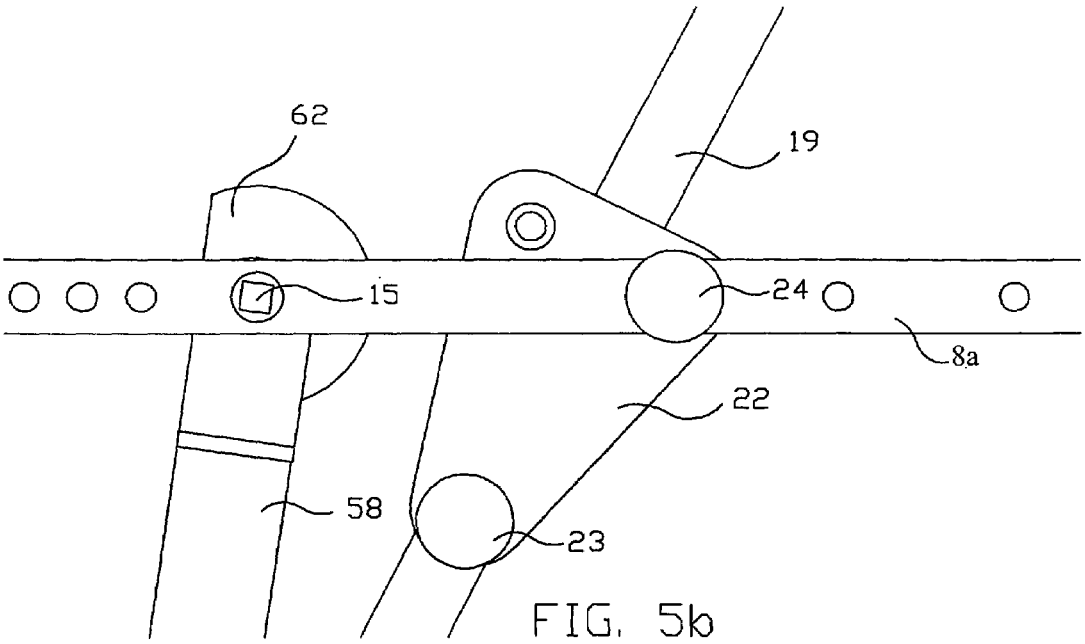
FIG. 5*b* shows the plan view of the correlation between the shuttle, connection bar, top pivot and handrail.

The operation of the exercise machine of the present invention is schematically illustrated in FIGS. 2*a*–2*c*, 3 and 7*a*–7*d*. An exerciser is seated on the seat pad 55, with both hands holding the handle 8, which is then pushed upwards. The force exerting upwardly on the handle 8 is designated as F. Through the two lever actions of the upper rocking bar member 8 and the lower rocking bar member 54, if the force F is greater than the force exerting on the seat pad 55 by the body weight W of the exerciser and the resultant force (F+W) of a reactive force F' of the seat pad 55, the handle 8 can be pushed upwards so as to cause the seat pad 55 to rise. It must be noted here that the displacement quantity $\alpha$ range of the handle 8 as the handle 8 is moved from illustrated positions A to B and back or from A to B to C and back, must be greater than the displacement quantity $\beta$ range of the seat pad 55 as the seat pad 55 moves from illustrated positions A to B and back or from A to B to C and back, so as to permit the exerciser to push the handle 8 upwards in a comfortable manner, as illustrated in FIGS. 2*a*–2*c*.

Figure 7A:
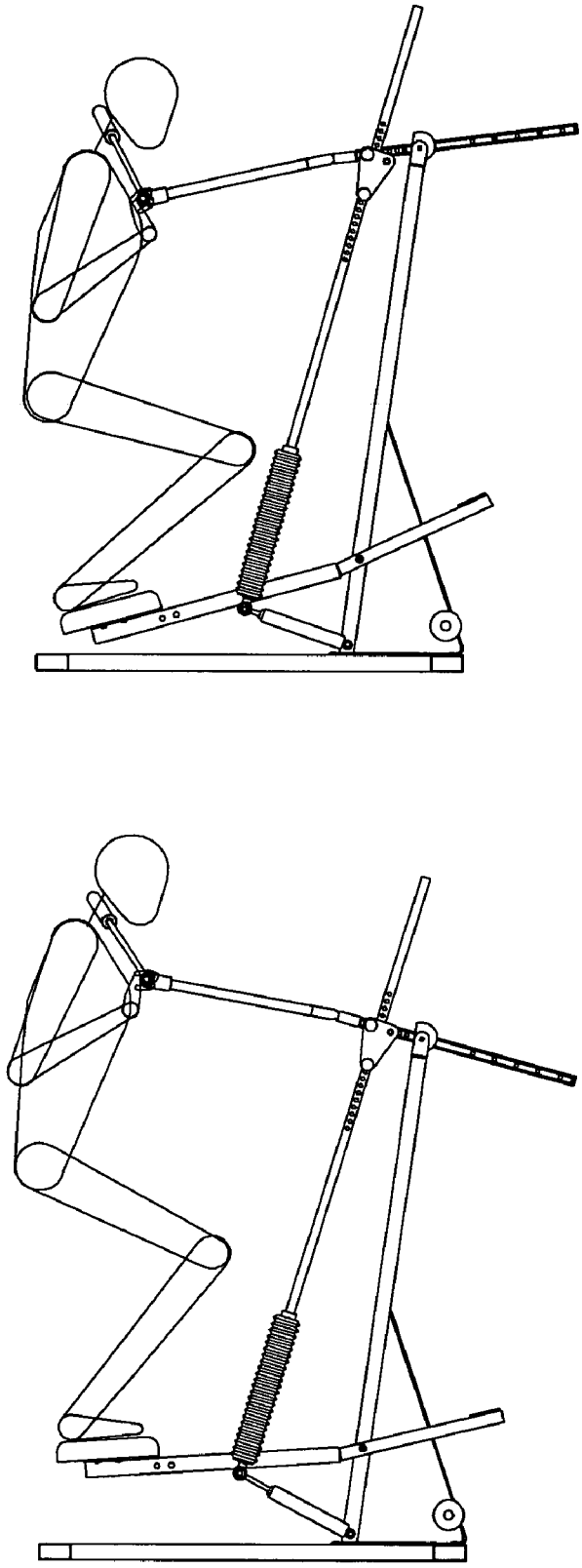
FIGS. 7*a*, 7*b*, 7*c* and 7*d* are schematic views illustrating the present invention in action.
Figure 7B:
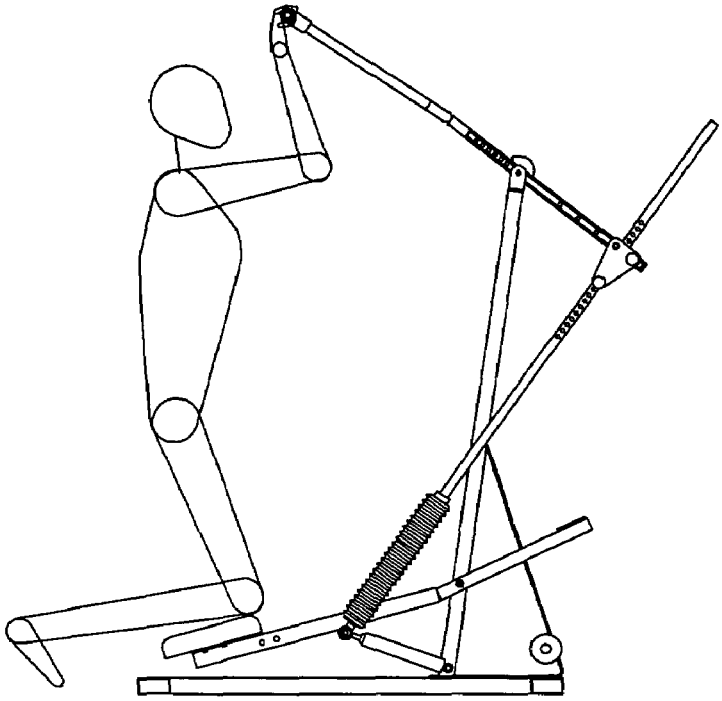
Figure 7B:
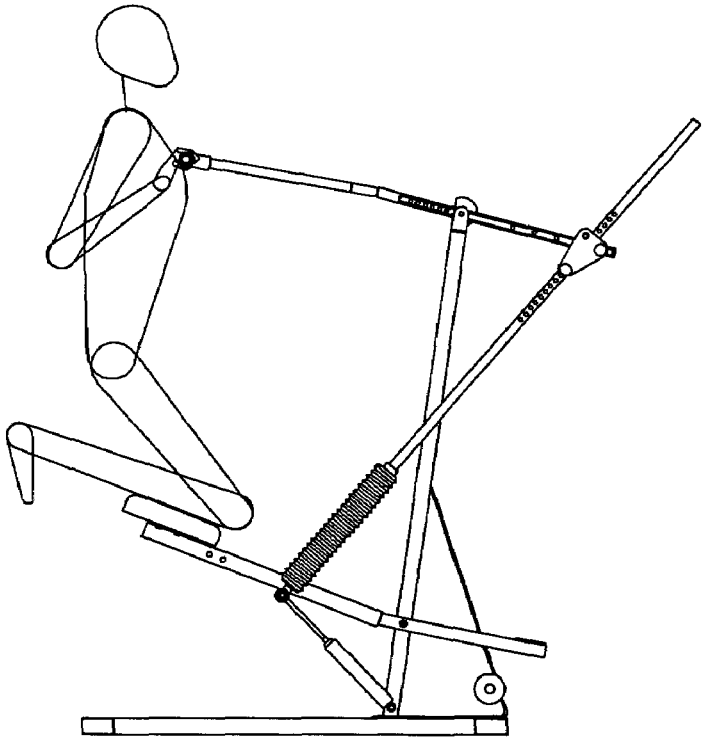
Figure 7C:
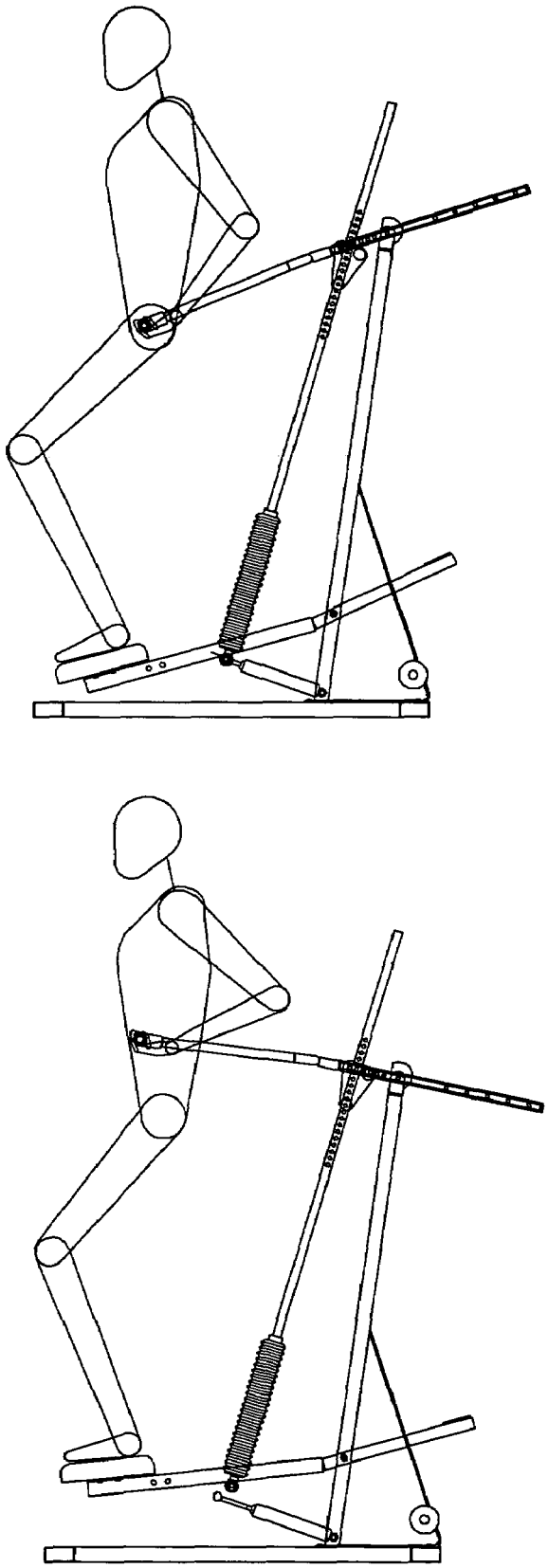
Figure 7D:
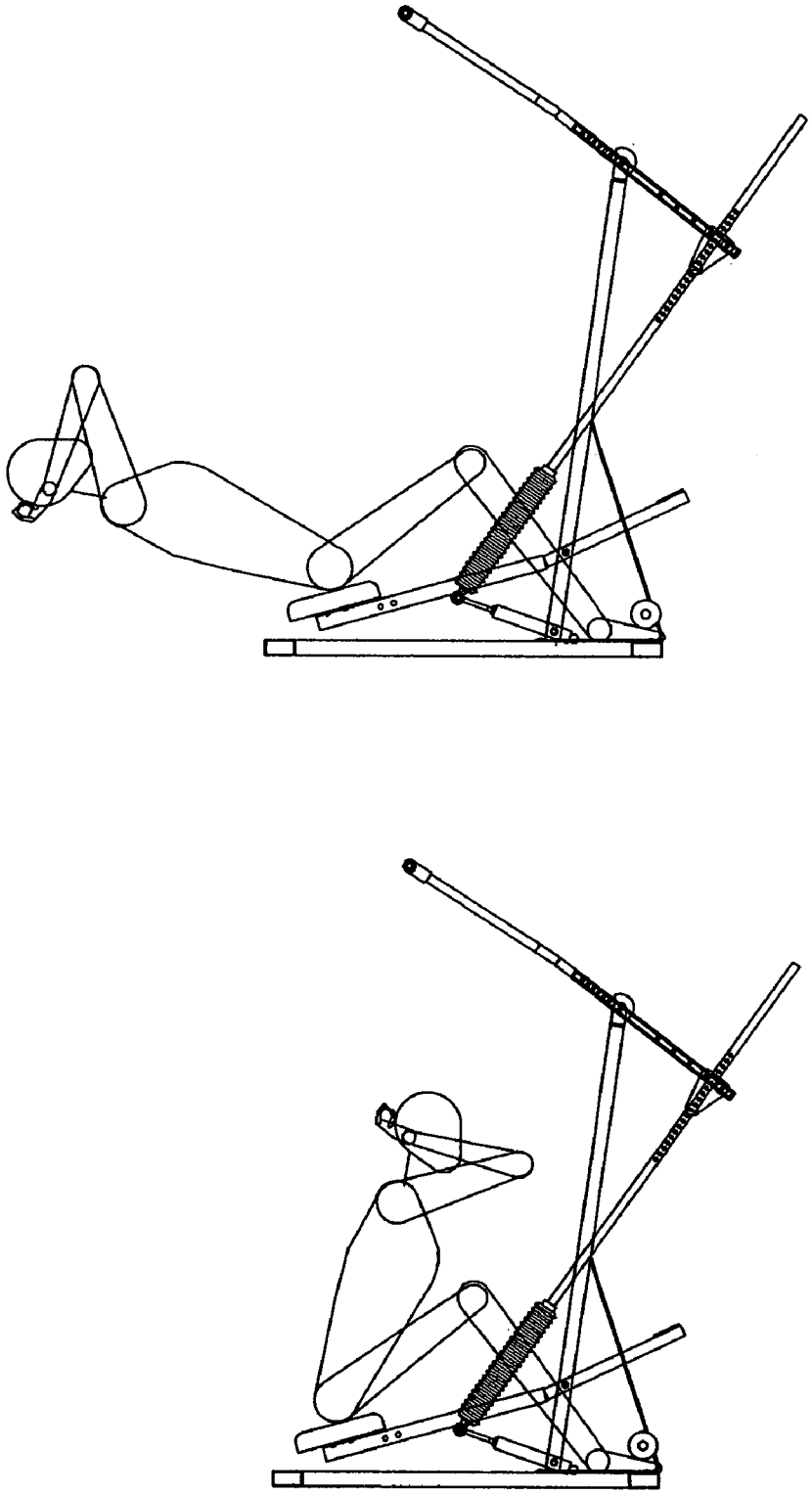

As shown in FIG. 7*a*, use of a detachable horizontal fixture 5, with a V-shaped portion 6 can be attached to the handle of the upper rocking member 8 via the threaded end caps 3 with pivotable fittings 1, which insert at handle grip ends 7, to provide another variation of use similar to the previously mentioned operation. An exerciser may use the exercise machine of the present invention by sitting, kneeling or standing on the seat pad 55.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

Now that the invention has been described,

What is claimed is:

1. An exercise machine making use of the body weight of an exerciser as a load weight thereof comprising:

a horizontal base;

a vertical bar member fastened obliquely at one end thereof to said base;

an upper rocking bar member provided with a predetermined number of spaced-apart through holes in a side edge of said upper rocking bar member and pivoted adjustably to a top end of said vertical bar member, the upper rocking bar member further including a spaced-apart elongate bar that runs parallel to the side edge of said upper rocking bar member and includes a plurality of spaced-apart through holes that align with the predetermined number of spaced-apart through holes in the upper rocking bar member;

a lower rocking bar member pivoted to said vertical bar member and located in a spaced-apart relationship underneath the upper rocking bar member;

a connection bar with both ends thereof pivoted respectively to said upper rocking bar member and said lower rocking bar member such that said connection bar is located to the side of the said vertical bar member, the connection bar further including a plurality of spaced-apart through holes for selective adjustment relative to the upper rocking bar member, and the connection bar extending between the upper rocking bar member side edge and its spaced-apart elongate bar;

a seat pad disposed on another end of said lower rocking bar member;

a padded back rest member having one end pivoted to said lower rocking bar member and another end lapped with a front surface of said vertical bar member;

a generally U-shaped handle bar fastened to a front end of said upper rocking bar member with hand grab means at each end thereof; and two cushioning members having one end pivoted to each side of said lower rocking bar member and another end pivoted to each corresponding side of said vertical support member for enabling said lower rocking bar member to return to a stationary position at a moderate pace;

wherein said connection bar further comprises:

a shuttle and two key pins with the lower end of the shuttle being pivotally and detachably connected to said vertical bar member;

the shuttle being formed with two parallel elates in a spaced-apart relationship with the connection bar being capable of moving between said plates;

the shuttle plates further having three through holes, two near the shuttle plate top edge and one near the shuttle plate lower edge, the lower edge holes being that through which one of the key pins is insertable for engagement with the connection bar and the remaining two holes near the upper edge being that through which the other key pin is insertable for selective engagement with the upper rocking bar.

2. The exercise machine of claim 1, wherein said vertical bar member comprises:

a vertical tube with one end fastened to said horizontal base.

3. The exercise machine of claim 1, wherein said cushioning members are oil-pressure cylinders.

4. The exercise machine of claim 1, further comprising:

a detachable cross member that pivotally connects to each end of the generally U-shaped handle, the cross member having a padded V shape at an intermediate location for alignment with an exerciser's neck.

5. The exercise machine of claim 1, wherein the connection bar further includes a compressed spring at its lower end near the pivotable connection to the lower rocking bar member.

* * * * *